US006135098A

United States Patent [19]

Allen et al.

[11] Patent Number: 6,135,098

[45] Date of Patent: Oct. 24, 2000

[54] FLOW-THROUGH CONTROLLABLE AIR CHARGER

[75] Inventors: David J. Allen, Gladstone; Brian K. Larche, Escanaba; Kenneth A. DeGrave, Wilson, all of Mich.

[73] Assignee: Engineered Machine Products, Inc., Escanaba, Mich.

[21] Appl. No.: 09/167,368

[22] Filed: Oct. 6, 1998

[51] Int. Cl.[7] ..... F02B 33/00

[52] U.S. Cl. ..... 123/565; 417/423.1

[58] Field of Search ..... 123/565; 417/423.1, 417/423.7; 415/222

[56] References Cited

U.S. PATENT DOCUMENTS

| | | | |
|---|---|---|---|
| 1,769,281 | 7/1930 | Zubaty . | |
| 1,979,747 | 11/1934 | Kenneweg . | |
| 2,866,594 | 12/1958 | Quick | 417/423.1 |
| 4,485,310 | 11/1984 | de Valroger . | |
| 4,680,933 | 7/1987 | Bozung et al. . | |
| 4,769,993 | 9/1988 | Kawamura . | |
| 4,884,406 | 12/1989 | Kawamura . | |
| 5,560,208 | 10/1996 | Halimi et al. . | |
| 5,591,017 | 1/1997 | Dwyer | 417/423.7 |
| 5,605,045 | 2/1997 | Halimi et al. . | |
| 5,638,796 | 6/1997 | Adams, III et al. . | |

FOREIGN PATENT DOCUMENTS

| | | | |
|---|---|---|---|
| 165822 | 9/1984 | Japan | 123/565 |
| 188028 | 10/1984 | Japan | 123/565 |

*Primary Examiner*—Noah P. Kamen
*Attorney, Agent, or Firm*—Brooks & Kushman P.C.

[57] ABSTRACT

An electric air charger for use with an internal combustion engine is disclosed. The air charger includes an impeller for supplying air to the engine. A housing surrounds the impeller and has an air inlet and an air outlet adapted to couple the air supplied by the impeller to the engine. The air inlet and the air outlet are substantially axially aligned. The air charger further includes an electric motor for controllably rotating the impeller.

20 Claims, 2 Drawing Sheets

Fig. 1
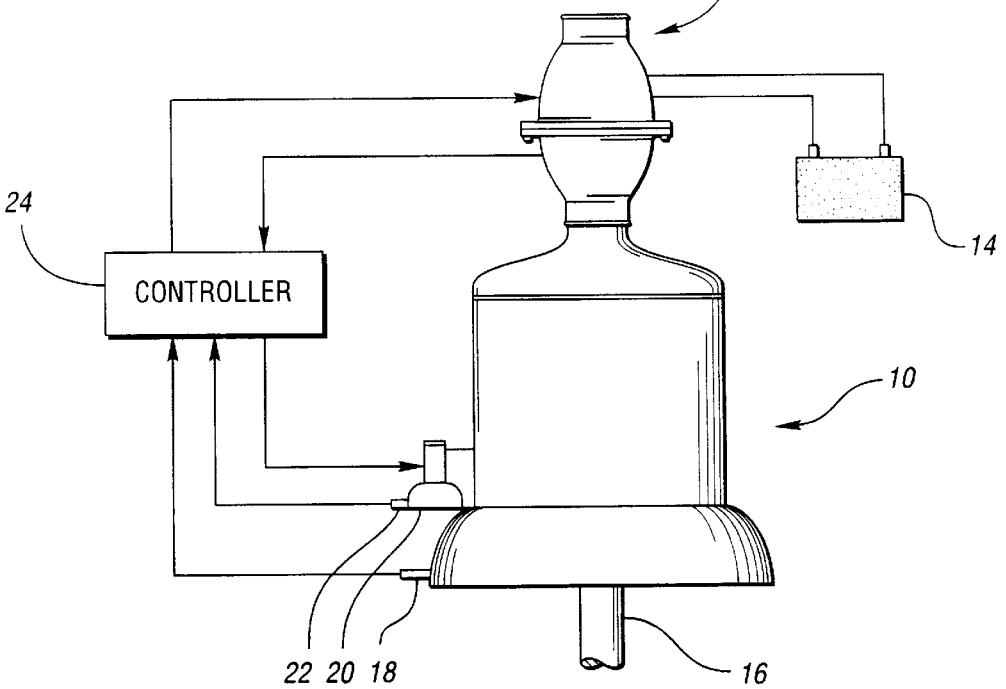
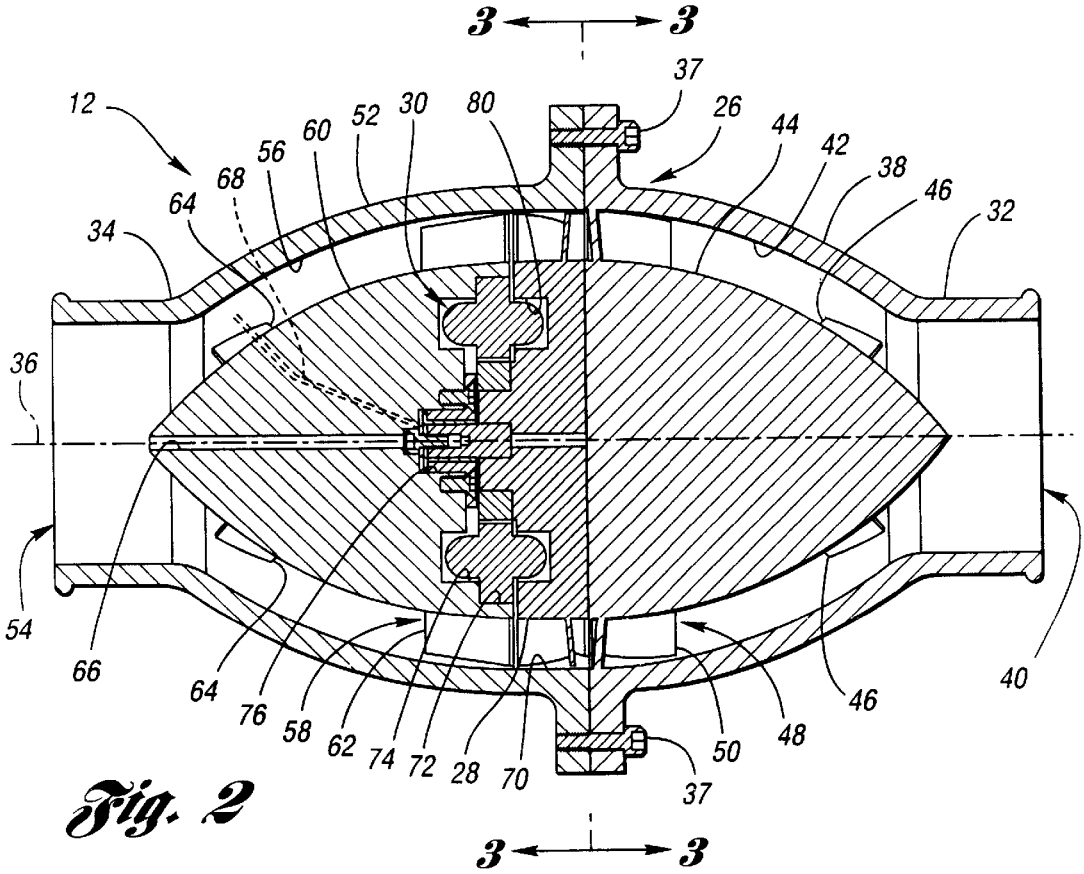
Fig. 2

FLOW-THROUGH CONTROLLABLE AIR CHARGER

TECHNICAL FIELD

The invention relates to a flow-through controllable air charger for controlling the air flow to an internal combustion engine.

BACKGROUND ART

An air charger may be used to increase the output power of an internal combustion engine by increasing the supply of air or combustible mixture to the cylinders of the engine. Prior air chargers include a compressor or blower which is typically driven by exhaust gases or by a crankshaft of the engine through a mechanical coupling. An air charger driven by exhaust gases, however, requires additional exhaust plumbing to route the exhaust gases to the air charger, and also must be designed to accommodate high temperatures associated with the exhaust gases. Such a design typically includes a costly coolant system to decrease the temperature of the charged air. An air charger mechanically driven by the engine tends to be relatively complex, and its placement is limited to certain locations within the engine compartment. Furthermore, the output air flow from these types of air chargers is typically not controllable unless some form of valving is also provided. Such valving, however, tends to be inefficient and inaccurate.

U.S. Pat. No. 5,638,796 shows an electric air charger for supplying air to the cylinders of an engine. This air charger includes a blower housing having an air inlet and an air outlet which are perpendicular to each other, a centrifugal blower mounted on one end of a shaft, and an electric motor having a rotor mounted on the opposite end of the shaft. Because air flow must be redirected between the air inlet and the air outlet, the air charger is relatively inefficient. Furthermore, the blower and the rotor are remote from each other, which adds to the inefficiency of the air charger and increases manufacturing costs. Finally, because the centrifugal blades are fixedly positioned on the blower, the blades cannot be adjusted during operation to improve efficiency of the air charger.

Accordingly, it is desirable to provide an air charger having improved efficiency and reduced cost.

SUMMARY OF THE INVENTION

The present invention overcomes the shortcomings of the prior art air chargers by providing a controllable electric air charger having a flow-through design for optimal efficiency. The design is also relatively simple, which enables the air charger to be manufactured at a reduced cost compared with prior art air chargers.

The invention is an electric air charger for use with an internal combustion engine. The air charger comprises an impeller for supplying air to the engine. A housing surrounds the impeller and has an air inlet and an air outlet adapted to couple the air supplied by the impeller to the internal combustion engine. The air inlet and the air outlet are substantially axially aligned. The air charger further includes an electric motor for controllably rotating the impeller.

In the preferred embodiment, the electric motor is disposed between the air inlet and the air outlet, and has a stator and a rotor. The stator is connected to the housing, and the rotor is mounted on the impeller.

Accordingly, it is an object of the invention to provide an improved electric air charger in which the air inlet and the air outlet are substantially axially aligned so that air flows substantially axially through the air charger.

Another object of the invention is to provide an improved electric air charger in which the electric motor controllably rotates the impeller to improve efficiency of the air charger.

A more specific object of the invention is to provide an improved electric air charger in which the rotor is mounted directly on the impeller.

Another more specific object of the invention is to provide an improved electric air charger in which the housing includes at least one cone shaped baffle.

Still another more specific object of the invention is to provide an improved electric air charger in which the housing includes at least one diffuser.

These and other objects, features and advantages of the present invention are readily apparent from the following detailed description of the best mode for carrying out the invention when taken in conjunction with the accompanying drawings.

BRIEF DESCRIPTION OF THE DRAWINGS

FIG. 1 is a schematic diagram showing an internal combustion engine having an electric air charger according to the invention.

FIG. 2 is an axial cross-sectional view of the electric air charger showing a housing, an impeller and an electric motor.

BEST MODES FOR CARRYING OUT THE INVENTION

Figure 3:
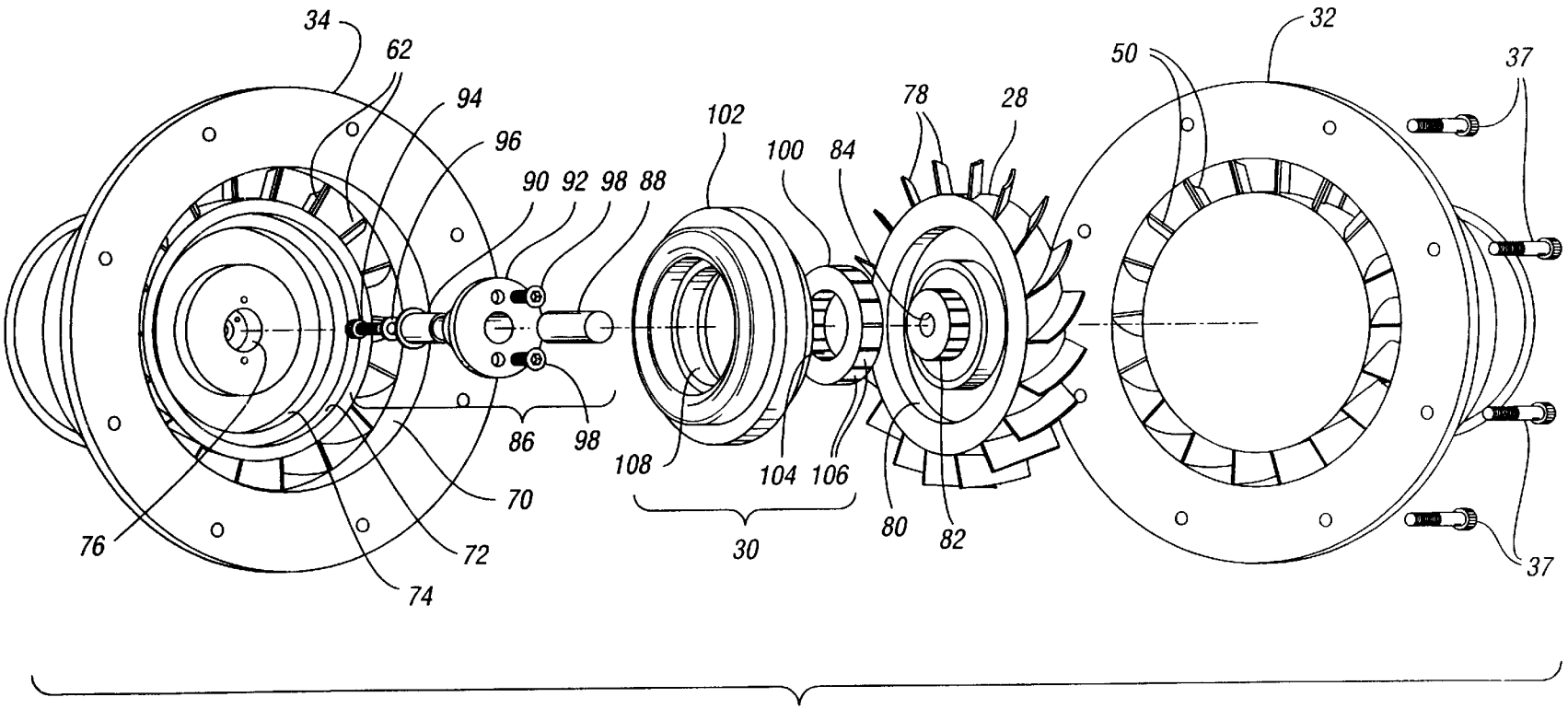
FIG. 3 is an exploded perspective view of the electric air charger shown in FIG. 2.

With reference to the drawings, the preferred embodiments of the invention will be described. FIG. 1 shows an internal combustion engine 10 equipped with an electric air charger 12, according to the invention, for supplying air to a combustion chamber or chambers, such as cylinders, of the engine 10. A battery 14 is connected to the air charger 12 for supplying electric power to the air charger 12. The engine 10 further has an output shaft, such as a crankshaft 16, and a sensor 18 for sensing the rotational speed of the crankshaft 16. A fuel injection pump 20 is connected to the engine 10, and has a sensor 22 for sensing the amount of fuel injected by the pump 20 into the engine 10. A controller 24 is preferably connected to the air charger 12, the sensor 18, the pump 20 and the sensor 22 for optimizing the air to fuel ratio supplied to the engine 10.

As shown in FIGS. 2 and 3, the air charger 12 comprises a housing 26, a blower, such as an impeller 28, and an electric motor 30 for controllably rotating the impeller. The housing 26 has first and second portions 32 and 34, respectively, which have a common axis 36 and are connected together by suitable fasteners such as bolts 37. The first housing portion 32 has a first, preferably cup-shaped shell 38, an air inlet 40 for receiving air into the air charger 12, and a first passageway 42. A first, preferably cone-shaped baffle 44 is connected to the shell 38 by tabs 46, and regulates air flow through the first housing portion 32 such that the air is diverted away from the axis 36 and into the passage 42. A first diffuser 48 is fixed to the shell 38 and the baffle 44, and includes a plurality of curved vanes 50 which impart non-axial flow patterns to the air before it contacts the impeller 28. The first housing portion 32 is preferably cast from aluminum as a single piece. Alternatively, the first housing portion 32 may be made in any suitable manner from any suitable material or materials. For example, the shell 38, baffle 44 and diffuser 48 may be made as separate pieces which are connected together in any suitable manner, such as by welding or press-fitting the pieces together. Furthermore, the baffle 44 may be formed with a hollow core to reduce weight.

The second housing portion 34 has a second, preferably cup-shaped shell 52 and an air outlet 54 which is axially aligned with the air inlet 40, and is adapted to be connected to the engine 10. The second housing portion 34 also has a second passageway 56, a second diffuser 58 and a second, cone-shaped baffle 60. The diffuser 58 is fixed to the shell 52 and the baffle 60, and includes a plurality of curved vanes 62 which impart axial flow patterns to the air exiting the impeller 28. The baffle 60 is connected to the shell 52 by tabs 64, and has an axially extending bore 66, a lubrication passage 68 and first, second, third and fourth recesses 70, 72, 74 and 76, respectively. The baffle 60 is preferably cone-shaped and regulates the air flow exiting the diffuser 58 such that the air is able to converge on the axis 36. The second housing portion 34 is preferably cast from aluminum as a single piece. Alternatively, the second housing portion 34 may be made in any suitable manner from any suitable material or materials. For example, the shell 52, diffuser 58 and baffle 60 may be made as separate pieces which are connected together in any suitable manner, such as by welding or press-fitting the pieces together. Furthermore, the baffle 60 may be formed with a hollow core to reduce weight.

The impeller 28 is rotatably disposed within the first recess 70, and has a plurality of fixed, curved vanes or blades 78 for moving air from the air inlet 40 to the air outlet 54. Alternatively, the air charger 12 may be provided with an impeller having moveable blades which can be adjusted during operation of the air charger to increase efficiency of the air charger. Furthermore, the air charger 12 may be provided with multiple impellers positioned in series for achieving a desired air flow rate and desired air pressure at the air outlet 54. The impeller 28 further has a fifth recess 80, a splined projection 82 and an axially extending bore 84 for receiving a support assembly 86 having a shaft 88. The impeller 28 is preferably press-fit onto the shaft 88 such that the impeller and the shaft are rotatable together. Additionally, the impeller 28 and the shaft 88 may be keyed or otherwise splined together. Alternatively, the impeller 28 and the shaft 88 may be connected together in any suitable manner such as with a fastener.

The support assembly 86 further includes a friction-reducing member, such as a bushing 90, and a bushing collar 92. The bushing 90 is rotatably connected to the shaft 88 using a suitable fastener or fasteners, such as a bolt 94 and a thrust washer 96. The bushing 90 is rotatably disposed within the bushing collar 92, which is fixedly disposed within the fourth recess 76, and is connected to the baffle 60 with suitable fasteners, such as screws 98. Alternatively, the support assembly 86 may be otherwise configured to provide axial support to the impeller 28. For example, the support assembly 86 may be provided with a bearing or bearings instead of the bushing 90 and/or the bushing collar 92. Because the support assembly 86 defines a relatively short moment arm relative to the bushing 90, the pivotal forces exerted on the bushing, as well as other components of the air charger 12, are relatively small compared with prior art air chargers. Consequently, the air charger 12 has improved reliability.

The electric motor 30 is preferably a variable reluctance direct current (DC) motor having a rotor 100 and a stator 102. Alternatively, the electric motor 30 may be any suitable type of variable speed or multiple speed motor which can controllably rotate the impeller 28. The rotor 100 preferably has a splined opening 104 which mates with the splined projection 82 for rotation therewith. Alternatively, the rotor 100 may be connected to the impeller 28 in any suitable manner such as with fasteners. A plurality of metal laminates 106 are preferably disposed about the periphery of the rotor 100. Alternatively, a plurality of magnets (not shown) may be disposed about the periphery of the rotor 100 if the electric motor is a permanent magnet DC motor.

The stator 102 is disposed within the second, third and fifth recesses 72, 74 and 80, respectively, and is preferably secured to the second housing portion 34 in any suitable manner. The stator 102 has a central opening 108 for receiving the rotor 100, and a plurality of windings adapted to be connected to a battery of the vehicle. The windings can be selectively energized to create a rotating electromagnetic field which acts upon the metal laminates 106 for inducing rotation of the rotor 100 and the impeller 28.

To assemble the air charger 12, the shaft 88 is inserted into the bushing 90, which is then inserted into the collar 92. Next, the thrust washer 96 is placed adjacent the bushing 90, and the bolt 94 is inserted through the washer 96 and threaded into the shaft 88 for rotatably securing the bushing 90 and the shaft 88 to the collar 92. The collar 92 is then inserted into the fourth recess 76, and is fastened to the second baffle 60 using suitable fasteners such as the screws 98.

Next, the stator 102 is press-fit or otherwise inserted into the second and third recesses 72 and 74. Additionally, the stator 102 may be fastened to the second baffle 60 using suitable fasteners. The rotor 100 is then placed on the impeller 28 such that the splined opening 104 mates with the splined projection 82. The rotor 100 and the splined projection 82 are then inserted into the opening 108. Finally, the first housing portion 32 is secured to the second housing portion 34 using the bolts 37 such that the impeller 28 is freely rotatable within the first recess 70. Alternatively, the housing portions 32 and 34 may be connected together in any suitable manner.

The bore 66 is configured to receive a suitable tool, such as a bolt driver, for tightening or loosening the bolt 94 when the air charger 12 is fully assembled. The lubrication passage 68 enables lubricating fluid to be easily injected into the fourth recess 76 for lubricating the support assembly 86.

Because the air charger 12 is driven by a controllable electric motor, the air charger 12 can optimize the air to fuel ratio provided to the internal combustion engine 10. Consequently, the air charger 12 can optimize fuel economy, decrease emissions and increase horsepower of the engine 10. In addition, because the rotor 100 is mounted directly on the impeller 28, energy transfer between the motor 30 and the impeller is optimized, thereby improving the controllability and efficiency of the air charger 12. Furthermore, such a design is less complex and less costly to manufacture as compared with prior art air chargers.

Because the air inlet 40 and air outlet 54 of the housing 26 are also substantially axially aligned, the air flow remains substantially axial through the air charger 12. Consequently, the air charger 12 exhibits increased flow capacity and efficiency as compared with prior art air chargers. Furthermore, the air charger 12 preferably has cone-shaped baffles 44 and 60 which divert air away from potential obstructions, such as the electric motor 30 and the support assembly 86, thereby increasing air flow efficiency.

Advantageously, because the baffles 44 and 60 are preferably made of aluminum, which is a heat-conductive material, heat from the motor 30 is quickly dissipated into the air passing through the air charger 12, thereby effectively cooling the motor 30. Finally, the air charger 12 can be used in other motor vehicle applications such as in an exhaust gas recirculation system to control exhaust gas flow, thereby decreasing emissions, or in any other applications where the above features are desirable, such as chemical processing, food processing, and other manufacturing applications.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, the invention may be practiced otherwise than as specifically described.

What is claimed is:

1. An electric air charger for use with an internal combustion engine, the air charger comprising:

a housing having an air inlet, an air outlet substantially axially aligned with the air inlet and adapted to be coupled to the engine, and first and second baffles disposed between the air inlet and the air outlet;

an impeller disposed between the baffles and extending radially beyond the baffles for supplying air to the engine; and an electric motor connected to the impeller for controllably rotating the impeller.

2. The electric air charger of claim 1 wherein the housing comprises first and second portions connected together, the first portion including the air inlet, and the second portion including the air outlet.

3. The electric air charger of claim 1 wherein at least one of the baffles is a cone-shaped baffle.

4. The electric air charger of claim 1 wherein the housing has at least one diffuser disposed between the air inlet and the air outlet.

5. The electric air charger of claim 1 wherein the electric motor is disposed between the air inlet and the air outlet and comprises a stator and a rotor, the stator being connected to the housing, and the rotor being connected to the impeller.

6. The air charger of claim 5 wherein the rotor is mounted directly on the impeller.

7. The air charger of claim 6 wherein the rotor has a first splined surface, and the impeller has a second splined surface that mates with the first splined surface.

8. The electric air charger of claim 1 wherein the electric motor is an electromagnetic motor and comprises a stator and a rotor, the stator being connected to the housing and the rotor being connected to the impeller and including at least one magnet.

9. The electric air charger of claim 1 wherein the electric motor is a variable-reluctance motor and comprises a stator and a rotor, the stator being connected to the housing and the rotor being connected to the impeller.

10. The electric air charger of claim 9 wherein the rotor further includes at least one metal laminate.

11. An electric air charger for use with an internal combustion engine, the air charger comprising:

a housing having an air inlet, an air outlet adapted to be coupled to the engine, and first and second baffles disposed between the air inlet and the air outlet;

an impeller disposed between the baffles and extending radially beyond the baffles for supplying air to the engine; and an electric motor disposed between the air inlet and the air outlet for controllably rotating the impeller, the motor having a stator and a rotor, the stator being connected to the housing, and the rotor being connected to the impeller.

12. The electric air charger of claim 11 wherein the rotor is mounted directly on the impeller.

13. The electric air charger of claim 11 wherein the air inlet and the air outlet are substantially axially aligned.

14. The electric air charger of claim 11 wherein the housing comprises first and second portions connected together, the first portion including the air inlet, and the second portion including the air outlet.

15. The electric air charger of claim 11 wherein at least one of the baffles is a cone-shaped baffle.

16. The electric air charger of claim 11 wherein the housing has at least one diffuser disposed between the air inlet and the air outlet.

17. The electric air charger of claim 10 wherein the electric motor is an electromagnetic motor and the rotor further includes at least one magnet.

18. The electric air charger of claim 10 wherein the electric motor is a variable-reluctance motor.

19. The electric air charger of claim 18 wherein the rotor further includes at least one metal laminate.

20. An electric air charger for use with an internal combustion engine, the air charger comprising:

a housing having an air inlet, an air outlet substantially axially aligned with the air inlet and adapted to be coupled to the internal combustion engine, and first and second baffles disposed between the air inlet and the air outlet;

an impeller disposed between the baffles and extending radially beyond the baffles for supplying air to the internal combustion engine; and an electric motor disposed between the air inlet and the air outlet for controllably rotating the impeller, the motor having a stator and a rotor, the stator being connected to the housing, and the rotor being mounted on the impeller.

* * * * *

UNITED STATES PATENT AND TRADEMARK OFFICE

CERTIFICATE OF CORRECTION

PATENT NO. : 6,135,098
DATED : October 24, 2000
INVENTOR(S) : David J. Allen et al.

It is certified that error appears in the above-identified patent and that said Letters Patent is hereby corrected as shown below:

Column 6,
Line 33, Claim 17, "10" should be --11--.
Line 36, Claim 18, "10" should be --11--.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*